US006938274B2

(12) United States Patent
Addington et al.

(10) Patent No.: US 6,938,274 B2
(45) Date of Patent: Sep. 6, 2005

(54) REINFORCED BOWLER'S FINGER SUPPORT

(76) Inventors: Randall A. Addington, 490 Spoonbill La., Melbourne Beach, FL (US) 32951; W. Robert Addington, II, 490 Spoonbill La., Melbourne Beach, FL (US) 32951

( * ) Notice: Subject to any disclaimer, the term of this patent is extended or adjusted under 35 U.S.C. 154(b) by 5 days.

(21) Appl. No.: 10/707,050

(22) Filed: Nov. 18, 2003

(65) Prior Publication Data

US 2004/0098788 A1 May 27, 2004

Related U.S. Application Data

(63) Continuation-in-part of application No. 10/064,390, filed on Jul. 9, 2002, now Pat. No. 6,658,669.

(51) Int. Cl.[7] ..... A41D 19/00
(52) U.S. Cl. ..... 2/161.1
(58) Field of Search ..... 2/16, 20, 160, 2/161.1, 161.2, 161.4, 161.5, 162, 163; 473/54, 55, 59–61

(56) References Cited

U.S. PATENT DOCUMENTS

| | | | | | |
|---|---|---|---|---|---|
| 2,391,851 | A | * | 12/1945 | Ellery | 2/21 |
| 3,152,337 | A | * | 10/1964 | Barry | 2/159 |
| 3,208,749 | A | * | 9/1965 | Skuse | 473/60 |
| 3,229,306 | A | * | 1/1966 | Bazar | 2/161.1 |
| 3,333,850 | A | * | 8/1967 | Miller | 473/60 |
| 3,344,436 | A | * | 10/1967 | Stubbs | 2/159 |
| 3,408,657 | A | * | 11/1968 | Gallagher | 2/159 |
| 3,726,525 | A | * | 4/1973 | Jackson | 473/61 |
| 3,880,426 | A | * | 4/1975 | Morse | 473/61 |
| 4,371,163 | A | * | 2/1983 | Shaffer et al. | 473/61 |

* cited by examiner

*Primary Examiner*—Gary L. Welch
(74) *Attorney, Agent, or Firm*—Joel I. Rosenblatt

(57) ABSTRACT

An adjustable tensioning strap is mounted in a glove worn on the bowling hand and connecting the glove finger tip and an anchor point proximate the wrist or palm. The tensioning strap, from the finger tip to the anchor point, is held adjacent the glove lining by one or more transverse support straps so when placed on the hand and with tension applied to the tensioning strap, the tensioning strap is held or forced by the transverse support straps toward and substantially adjacent the bowler's finger and palm.

17 Claims, 6 Drawing Sheets

(right handed bowler)

(left handed bowler)

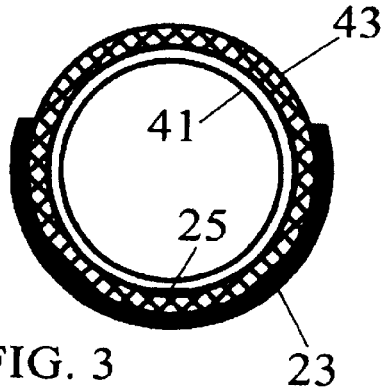
FIG. 3
FIG. 3a
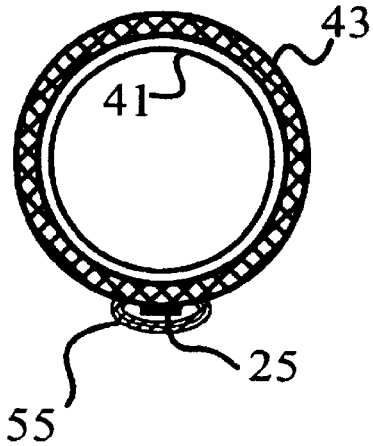
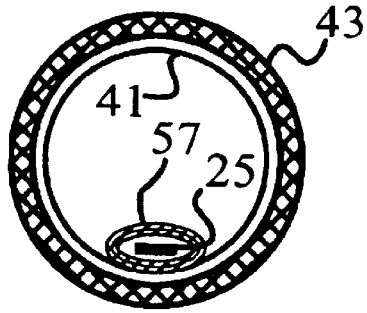
FIG. 3b (right handed bowler)

(left handed bowler)

REINFORCED BOWLER'S FINGER SUPPORT

CROSS REFERENCE TO RELATED APPLICATIONS

This is a continuation in part of the application of Randall A. Addington, et al., Ser. No. 10/064,390 filed Jul. 9, 2002 now U.S. Pat. No. 6,658,669 for Bowlers Aid Support And Control.

BACKGROUND OF INVENTION

In order for a bowler to have the greatest advantage in his attempt to consistently score the maximum number of pins, the bowling ball is released from one or more of the middle fingers by applying pressure to ball through the bowling ball finger holes in a complex motion known to those skilled in the art as lift. Lift, as known in bowling and as shown for example in U.S. Pat. No. 4,371,163 of Shaffer, means imparting to the ball the two rotary motions of roll and spin. To achieve roll, the ball is made to rotate in a forward and downward direction relative to the horizontal axis along the direction of travel of the ball toward the pins and to achieve spin, the ball is made to rotate with a rotational component about the vertical axis of the ball, as viewed from above a ball thrown with the right hand. It is the spin that causes a desired scattering of the falling pins, increasing the chance for a strike.

As stated above, this complex motion of imparting two rotary motions of roll and spin is known to those skilled in the art as lift. Lift is produced, after the thumb has been removed from the ball, by one or more of the middle fingers applying a force to the ball at its release to rotate the ball upward, imparting the desired roll and spin. To perform this operation in the best manner requires the bowler, in releasing the ball, to consistently apply his maximum force through one or more of the bowler's middle fingers, against the interior surface of the bowling ball finger hole. In bowling, this operation is repeated from a minimum of twelve for a perfect game, to a maximum of twenty one times, depending on the bowler's success in scoring a strike or spare in the last regular frame. Multiplied by a number of games, for example in league play, there is typically three full games with a minimum of thirty six ball released to a maximum of sixty three balls released. The multiplied acts of bowling, involving lifting the ball on its release, produces multiple strains and stresses on the bowler's finger. Critical to properly lifting and releasing the bowling ball, is maintaining the best possible positioning of the middle finger or fingers against the bowling ball hole, to consistently apply the proper amount of lift to the ball. As the hard surface of the bowling ball finger hole is continually forced against the bowler's extended finger, producing stress and strain in the finger, the ability of the bowler to maintain consistent control through middle finger or fingers at the ball release, is reduced, detrimentally affecting the bowler's ability to consistently lift the ball and consistently score strikes.

In attempts to adjust the curved position of the finger, a strap was used as shown in U.S. Pat. Nos. 3,152,337 and 3,880,426. As shown therein the strap was adjustable relative to an anchor point on the wrist. However the devices as shown in these patents placed the strap in a straight line locus from the curved finger tip area to the anchor point, imposing a space between the strap and the finger and palm. The size or depth of the space was relative to the adjustment made to the position of the finger tip, the amount of tension applied to the strap, the curve produced in the finger, and the relative placement or disposition of the strap to the wrist anchor point. As a consequence, when the bowler placed his finger into the bowling ball finger hole with the finger and palm forced against the ball, the strap extending in a line from the curved finger to the wrist anchor point, was forced against the finger and palm, changing the straight line locus of the strap from the finger to the anchor point, to a curved line locus from the finger to the palm and changing the original adjustment to the strap and its force on the finger, as previously made by the bowler.

SUMMARY OF INVENTION

As shown in a preferred embodiment, this invention according to the inventive principles disclosed, in FIGS. 7, 8, and 9, discloses the use support straps to be used with an adjustable tensioning strap mounted in a glove adapted to be worn on the bowling hand and connecting or terminating at a first end proximate the glove finger tip or a finger pad protector placed at the glove finger tip and disposed opposite the position of the bowler's finger pad, and at a second end, at an anchor point proximate the glove part enclosing the wrist or palm. As shown and described in co pending application Ser. No. 10/064,390 filed Jul. 9, 2002 for Bowler's Aid Support And Control, the tensioning strap, from its first end to its second end, is held adjacent the glove lining so when placed on the hand and with tension applied to the tensioning strap, a curve is produced in the finger while the tensioning strap is held or forced by the glove toward and substantially adjacent the bowler's finger and palm, and describing a curved line locus from the first end to the second end of the tensioning strap and with the curved locus substantially adjacent the length of the bowler's finger or palm.

As shown in co pending application Ser. No. 10/064,390 filed Jul. 9, 2002 for Bowler's Aid Support And Control, the tensioning strap may be adjusted relative to the second anchor point proximate the glove palm or wrist, by applying a tensioning force in a direction away from the finger tip and in the direction from the finger to the wrist and whereby the tensioning force on the tensioning strap will serve to draw the finger into a curved position with the finger tip pulled toward the wrist. The adjustment is variable depending upon the needs of the individual bowler when grasping the bowling ball and when in the initial part of the ball release when the bowler's arm is in an up swing, and when the bowler is starting his release by initiating a lifting force through the middle fingers, as would be known to those skilled in the art.

As in co pending application Ser. No. 10/064,390 filed Jul. 9, 2002 for Bowler's Aid Support And Control, in accordance with the principles of the disclosed invention, the tension strap may be an elastic material, stretching or elongating under a tension force or substantially non-elastic and substantially not stretching or elongating under a tension force, according to the disclosed principles of the invention as shown for a preferred embodiment. When substantially non-elastic, the tension strap may be adjusted with the middle finger in an extended or neutral position, relative to a curved or flexed position, to resist the force of the bowling ball at release and to support the middle finger from being forced backward in a hyper-extended position where stress or strain would be imposed on the finger. For an elastic tension strap, the elastic resistance to a tension force may be varied to produce a restoring force in the tension strap when the middle finger is extended in a neutral position, to substantially to resist the force of the bowling ball at release and to support the middle finger from being forced backward in a hyper-extended position where stress or strain would be imposed on the finger. A shown in co pending application Ser. No. 10/064,390 filed Jul. 9, 2002 for Bowler's Aid Support And Control, the tensioning strap may be an elastic or stretchable material so the finger may be extended against the tensioning force of the strap in the process of releasing and lifting the ball. In this way the curved position of the finger and the force holding the finger in its curved position and through its extended position when releasing and lifting the bowling ball, as explained above, may be adjusted by each individual bowler. As the restoring force exerted by an elastic material is proportional to its stretched extension, relative to its relaxed or rest position, as would be known by those skilled in the art, the force exerted by the tensioning strap against the finger is proportionally greatest when the finger is fully extended. This restoring force produced in the tensioning strap, acts in the direction of finger flexure and away from the finger tip and towards the palm or wrist, to force the finger to retain its adjusted curved position and to resist the force of the bowling ball on the bowler's finger at the ball release which is a direction of finger hyper extension, forcing the curve of the finger to open or if the finger is fully extended, to force the finger back past an extended neutral position into a hyper extended position and placing additional strain and stress on the finger. The adjustment made by the bowler using the tensioning strap adjustment and the force of the adjusted tensioning strap against the finger tip, adjusts the bowler's finger into an adjusted curved position, whereby the tensioning strap force can resist or counter balance the opposite force of the bowling ball against the finger tip in the direction of hyper extension, at the ball release and thereby reduce the stress and strain placed on the finger. As shown in co pending application Ser. No. 10/064,390 filed Jul. 9, 2002 for Bowler' Aid Support And Control, according-the principles of the disclosed invention, the finger pad protector may comprise a finger pad protector protecting the finger pad and a part of the finger extending from the finger pad toward the first or second finger joint. As force is applied to the tensioning strap, forcing the finger toward an adjusted curved position, the tension force in the tensioning strap is from the first anchor point or location at the finger tip as shown in a preferred embodiment, to a second anchor point or location proximate the wrist, as shown in a preferred embodiment. That tension force forces the locus described by the tensioning strap into a straight line creating a gap between the tension strap and the palm or finger. However, according to the principles of the disclosed invention, and as disclosed in a preferred embodiment, herein, a substantially transverse force is applied to the tensioning strap forcing it in a locus described by a curved line substantially following the adjusted curve of the finger. As shown in copending application Ser. No. 10/064,390 filed Jul. 9, 2002 for Bowler's Aid Support And Control, as shown a preferred embodiment, and according to the principles of the disclosed invention, the force holding the tensioning strap adjacent the finger and palm, may be produced by the glove lining forming a conduit for the tension strap or as disclosed by the inventive principles shown in this application, may be produced according to a preferred embodiment, by one or more support straps which may be placed at an angle to the tensioning strap or transversely across the tensioning strap to produce a force in the direction of the finger or palm, forcing the locus of the tension strap, from its first anchor point or location or connection proximate the finger tip or finger pad to the second adjustable connection, or location or anchor point, into an adjusted curved position, as described by a line from the first tension strap connection to the second tension strap connection, substantially following the adjusted curve of the finger and substantially adjacent the finger or palm. In this way, there is substantially no gap or space created or imposed between the tensioning strap and the finger or palm, to be taken up or compressed and eliminated or removed, when the bowler grips the ball, and the locus of the tensioning strap as initially adjusted, is substantially not affected when the bowler places his finger in the bowling ball hole and forces the glove and tensioning strap against the bowling ball surface.

As shown in a preferred embodiment, one or more of the support straps may be located on the inner lining and covered by the outer lining so the support straps and the tensioning straps are isolated from contact with the surface of the bowling ball. The support straps may be stitched into the inner lining or held in place by fasteners as would know to those skilled in the art or by a suitable adhesive.

Accordingly, it is an object of this invention to use a tension strap to adjust the curved position of the bowler's finger and to support the bowler's finger against the force of the bowling ball, when the bowler's is extending the finger in the release and lifting of the bowling ball. Another object is to support the tension strap in its adjusted position, against the finger or the palm by a means imposing a restraining force against the tension strap and the tension force in the tension strap.

Another object is to support the tension strap in its adjusted position against the finger or the palm by a means imposing a counter force or restraining against the tension strap, in the direction of the finger or palm and for restraining the tension strap in a locus substantially adjacent the finger or palm.

BRIEF DESCRIPTION OF DRAWINGS

FIG. 3, as shown in co pending application Ser. No. 10/064, 390 filed Jul. 9, 2002 for Bowler's Aid Support And Control, shows a cross section of the glove finger proximate the finger pad and with tension strap between the glove inner and outer layers and with finger pad protector located proximate the finger tip. FIG. 3*a*, as shown in co pending application Ser. No. 10/064,390 filed Jul. 9, 2002 for Bowler's Aid Support And Control, shows the cross section of the glove finger of FIG. 3 with the tension strap in a conduit adjacent the glove outer lining but without the finger pad protector as shown in FIG. 3, for the purpose of explanation.

FIG. 3*b*, as shown in co pending application Ser. No. 10/064,390 filed Jul. 9, 2002 for Bowler's Aid Support And Control, shows cross section of the glove finger of FIG. 3 with the tension strap in a conduit adjacent the glove inner lining but without the finger pad protector as shown in FIG. 3, for the purpose of explanation.

DETAILED DESCRIPTION

Figure 1:
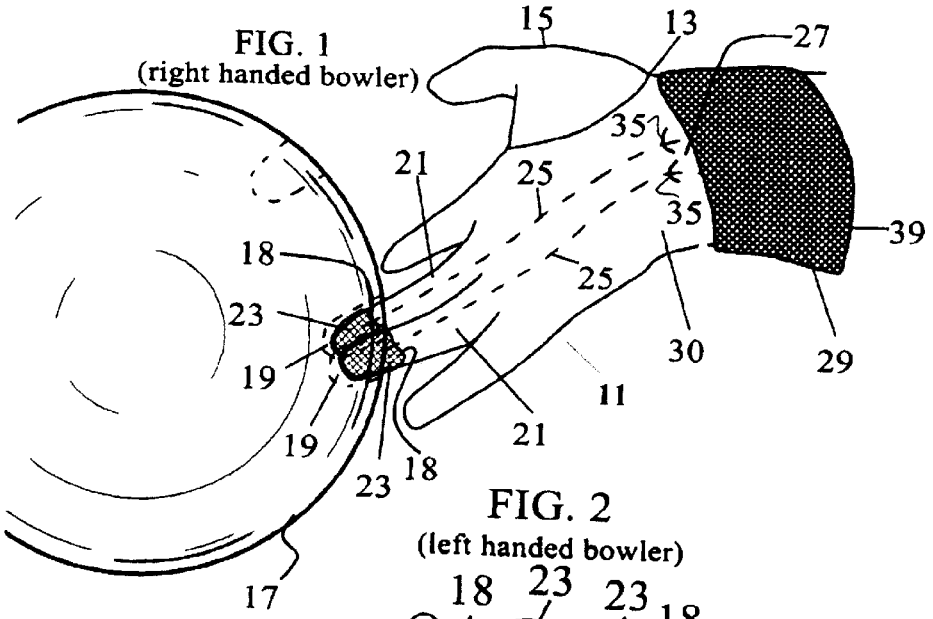
FIG. 1, as shown in co pending application Ser. No. 10/064,390 filed Jul. 9, 2002 for Bowlers Support Aid And Control, shows the bowler's fingers in an extended position in the release of the bowling ball with the tension straps shown in phantom mounted in a right handed glove and extending from proximate the finger tip to an anchor point proximate the bowler's wrist, and with the straps anchoring the tension strap in a closed or anchor position.

In the drawings shown herein, the same numerals are used to show the same or similar parts. FIGS. 1 to 6, show the invention as shown in co pending application Ser. No. 10/064,390 filed Jul. 9, 2002 for Bowler's Aid Support And Control.

Figure 2:
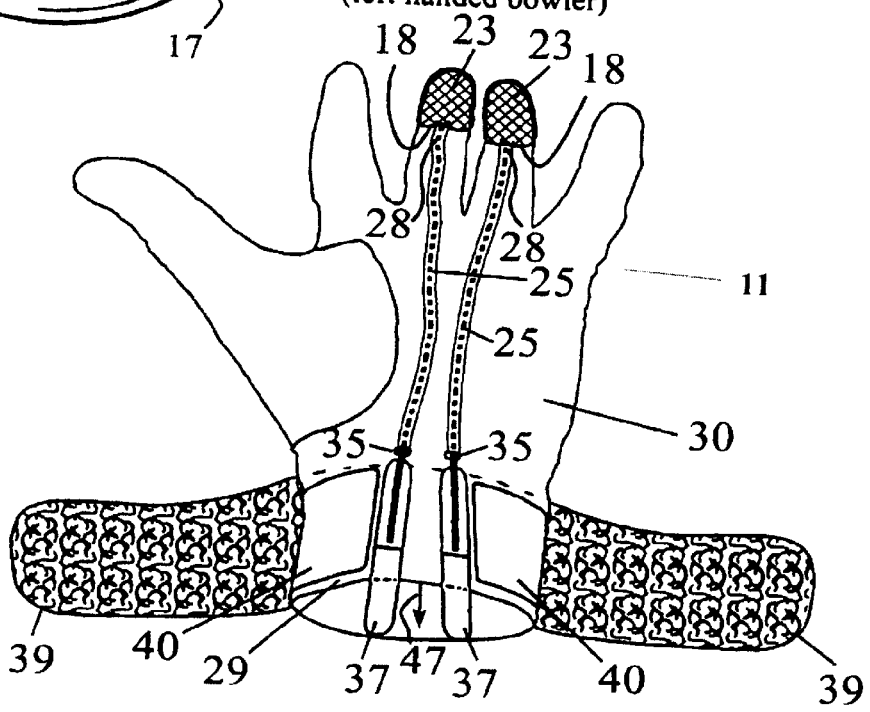
FIG. 2, as shown in co pending application Ser. No. 10/064,390 filed Jul. 9, 2002 for Bowler's Aid Support And Control, shows the glove of FIG. 1 in a view toward the palm and on a left handed bowler with the tension straps shown in phantom, adjusted to produced a curve in the middle finger and with the wrist mounted anchor straps open, and the tension strap anchor tabs exposed for view.
Figure 4:
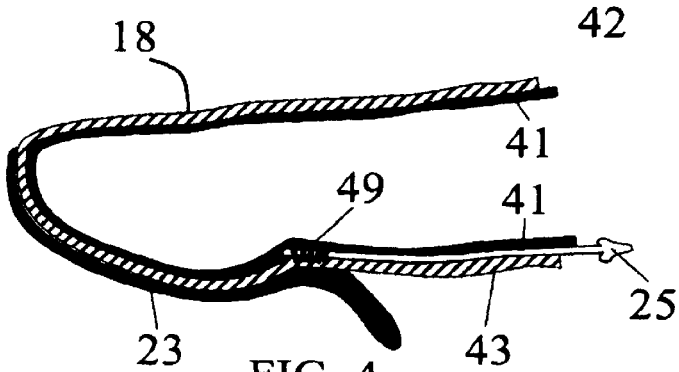
FIG. 4, as shown in co pending application Ser. No. 10/064,390 filed Jul. 9, 2002 for Bowler's Aid Support And Control, shows cross sectional view of the glove middle finger showing the tensioning strap attached to the glove proximate the finger pad and located between the glove inner and outer layers.

FIG. 1 shows the invention in a bowler's right handed bowling glove generally indicated by numeral 11 with thumb opening 13 for thumb 15. The bowler's glove is shown on the bowler's right hand with the bowler's finger tips 18, inside the bowling ball 17, finger holes 19, at the moment of the ball release and with the fingers 21 extended in a substantially neutral position, as would be known to those skilled in the art of bowling, to lift the ball and impart rotation and spin. In FIG.1, two middle fingers 21 are shown but as would be known to those skilled in the art, any combination of middle fingers may be used to lift and release the ball and the inventive principles are not limited to the number or combination of fingers used to bowl. Finger pad protectors 23 are shown proximate the glove finger tips 18. The finger pad protectors 23 add additional protection for the finger tips 18 from the force of the bowling ball at its release. The finger pad protectors according to a preferred embodiment, may be limited to the finger tip or may extend to the first finger joint. Tension straps 25 are shown (in phantom) in a path or locus between the inner and outer glove layers and extending from a first connection 28 (shown in FIGS. 1, 2, and 5), generally shown proximate the finger tips 18 to a second connection at an anchor point 27 (shown in FIG. 1), proximate the bowler's wrist 29 or palm 30. The invention shown in FIG. 1 is shown in FIG. 2, reversed in a left handed glover with the same or similar parts having the same numerals. The use of a right handed glove in FIG. 1 and a left handed glove in FIG. 2 is made to demonstrate the invention may be used by right or left handed bowlers without departing from the principles of the disclosed invention. The tension straps 25 are shown in a preferred embodiment for example, terminated at first connection point 49, proximate the finger tip shown in FIG. 4, at a location which is proximate the finger tips 18 and finger pad protector 23 and which may be varied in that proximately given location as shown and described with reference to FIG. 1 and FIG. 2, herein. The tension strap 25 connection 49, is shown as stitched to the glove lining, shown generally in FIG. 4 by numeral 42, but as would be known to anyone skilled in the art, any suitable connection of the tensioning strap to the finger tip may be used, as now or hereafter knownln a preferred embodiment, the tension straps 25 are placed between the inner lining 41 and outer lining 43 of the glove and held thereby substantially adjacent the opposed finger and palm as shown in FIGS. 3 and 4. The tensioning straps may be brought out of the glove lining at glove openings 35 and terminated in anchoring tabs 37 which,are used to hold the tensioning strap in its adjusted position, in connection with anchor straps 39, as shown in FIGS. 2 and 6, in an open position and in FIGS. 1 and 5, in a closed position, as explained below. The tension straps 25 may be retained substantially adjacent the glove lining as shown by placing the tensioning straps within a conduit formed by the glove lining as shown in FIGS. 3 and 4 or an adjacent conduit formed exterior, or interior to the glove outer or inner lining, respectively, as would be understood by those skilled in the art from a description of a preferred embodiment and according to the inventive principles disclosed herein. The conduit may be formed as shown within the glove inner and outer linings as shown in FIG. 3, or as shown in FIG. 3*a*, by an additional layer forming a conduit 55 placed contiguous to the outer lining or exterior 43, as shown in FIG. 3*a*, and in FIG. 6, or by an additional layer forming a conduit 57 contiguous to inner lining or interior 41, as shown in FIG. 3*b*. For the purpose of explanation, the finger pad protector 23, shown in FIG. 3, is not shown in FIG. 3*a* or 3*b*, but which would be understood by those skilled in the art as located proximate the finger tip 18, as shown in FIGS. 1, 2, 4, 5 and 6. As would be understood by those skilled in the art from a description of a preferred embodiment and disclosure of the inventive principles, herein, the conduit 57 enclosing tension strap 25, may be placed in the interior of the glove lining, shown generally in FIG. 4 by numeral 42, adjacent inner lining 41 According to the disclosed inventive principles, a separate conduit, as shown by numeral 57 in FIG. 3*b*, may be attached to the inner lining 41 of the glove lining 42 and the tension 25 strap contained therein, without departing from the disclosed inventive principles. As would be understood by those skilled in the art from a description of a preferred embodiment and disclosure of the inventive principles, herein, the conduit 57, enclosing tension strap 25, may be placed adjacent the inner lining 41 and its counterpart conduit 55 may be placed adjacent the outer lining 43, of the glove lining shown generally by numeral 42 without departing from the disclosed inventive principles.

The means for anchoring the tensioning strap at the second connection may be anchor tabs 37 as shown in a preferred embodiment, which may be made with a VELCRO hook and loop type, fastening material surface for cooperation as known to those skilled in the art, with VELCRO hook and loop type, fastening material on straps 39, and with a VELCRO hook and loop type, fastening material on complementary strap surface 40. As would be apparent to those skilled in the art, the VELCRO hook and loop type, fastening material surfaces could be reversed and other means known by those skilled in the art could be used to anchor the tensioning strap in its adjusted position, without departing from the principles of the disclosed invention.

Figure 5:
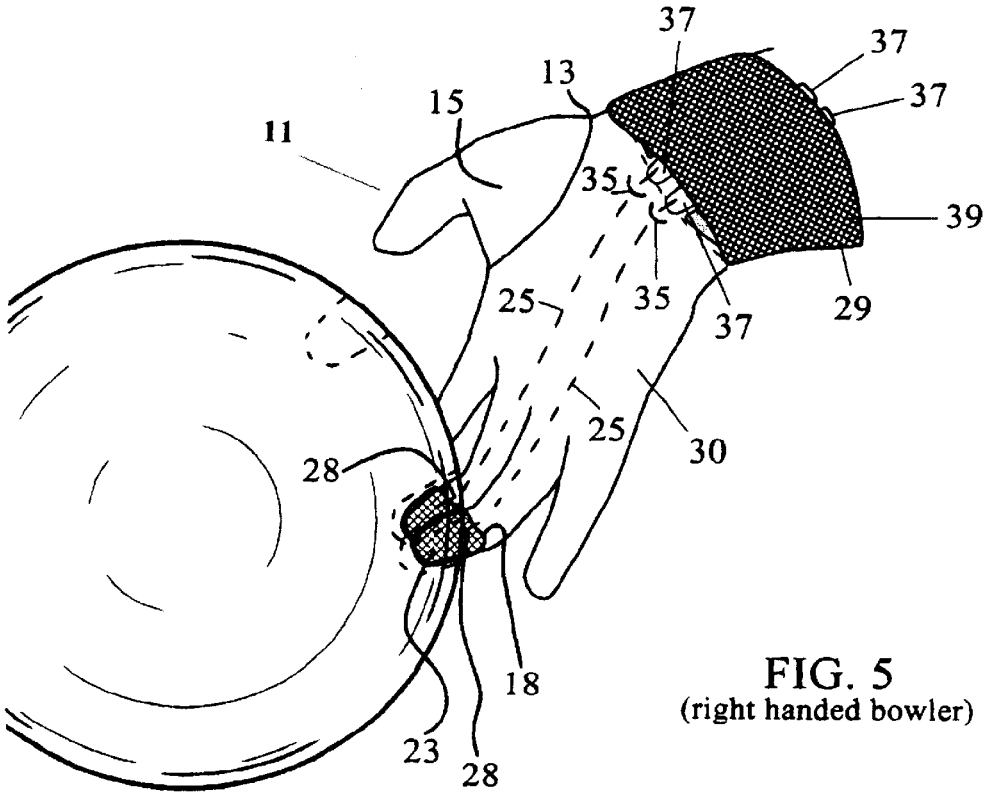
FIG. 5, as shown in co pending application Ser. No. 10/064,390 filed Jul. 9, 2002 for Bowler's Aid Support And Control, shows the glove of FIG. 1 with bowler's fingers in an adjusted curved position when starting the release of the bowling ball.
Figure 6:
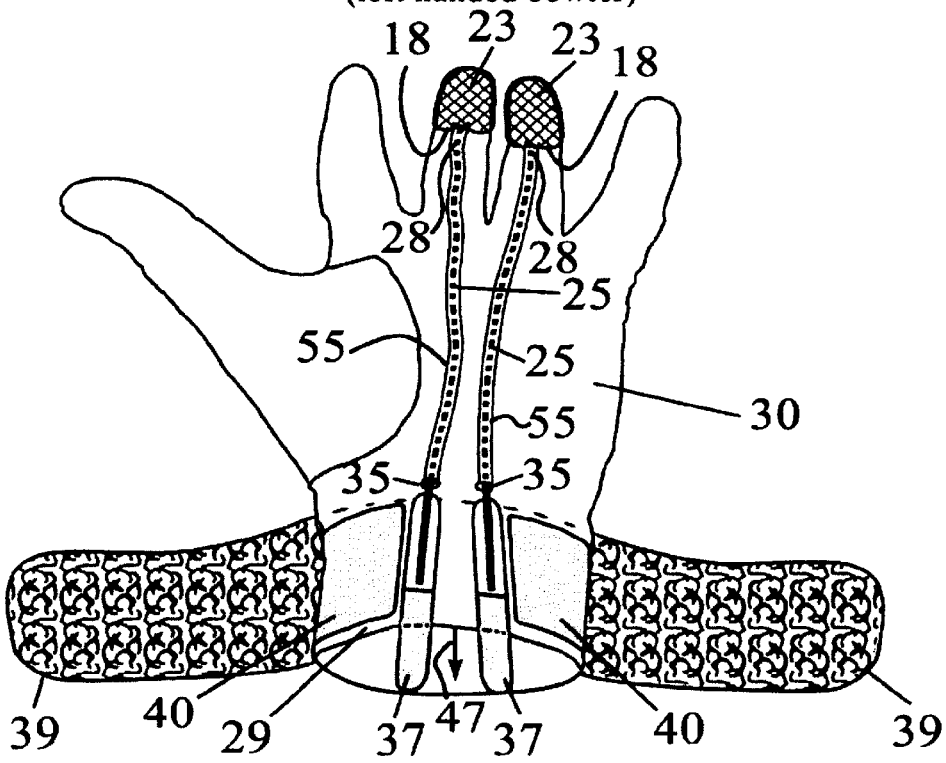
FIG. 6 as shown in co pending application Ser. No. 10/064,390 filed Jul. 9, 2002 for Bowler's Aid Support And Control, show bowler's fingers in an extended position in the release of the bowling ball with the tension straps shown in phantom mounted within an exterior conduit in a left handed glove and with the exterior conduit extending from proximate the finger tip to an anchor point proximate the bowler's wrist, and with the straps anchoring the tension strap in a closed or anchor position.

In operation, the anchor tabs 37, as shown for a preferred embodiment, can be pulled in the direction of arrow 47, away from the opposed tensioning straps 25 and the first connection 28 proximate the finger tips 18, thereby pulling the fingers tips 18 and the fingers 21 into an adjusted curved position, as shown in FIGS. 2 and 5, relative to its extended position as shown in FIG. 1. In FIGS. 2 and 5, the two middle fingers are shown foreshortened in FIG. 2 and curved in FIG. 5, as pulled into a curved position by displacing the anchor tabs 37 in the direction of arrow 47 and drawing the finger tips 18 toward the anchor strap 39, so the curved fingers are flexed and concave relative to a view from the palm. The straps 39 upper and lower linings and the surface of the anchor tab 37, may be made of complementary VELCRO hook and loop type, fastening material, so one of the straps 39, for example the right side strap as shown in FIG. 2, may be wrapped over the anchor tabs 37 in their adjusted position, locking the anchor tab 37 in place, and then the second strap or left side strap, may be wrapped over the first strap with the opposed straps engaged by their respective complementary VELCRO hook and loop type fastening material surfaces.

According to the inventive principles disclosed, the adjustment made to the tensioning straps and the adjusted amount of curvature of the middle finger 21 may be made variable by the variable displacement of the tension straps 25 by an adjustable transverse displacement of anchor tabs 37 relative to the second connection anchor point proximate the wrist 29 or palm 30, with the curvature of the finger increasing as the tensioning straps 25 and the anchor tabs 37 are pulled in the direction of arrow 47 transverse across the bowler's wrist 29 and the cooperating parts of straps 39, and thereby applying a tension force to the tensioning straps 25 and through the tensioning straps 25, a force to the finger tips 18 to pull the finger tips toward the palm or wrist and into an adjusted curved position.

According to the disclosed inventive principles, the tension strap 25 may be an elastic material which allows the bowler to extend the middle finger 21 from its adjusted curved position as shown in FIG. 2 and FIG. 5, as when the ball is grasped, to its extended position as shown in FIG. 1, when the ball is released and lift is applied to the ball. A suitable elastic material would be known to those skilled in the art and does not form a part of the invention. The elastic material of the tension straps 25 produces an increasing flexing force on the finger tips 18 as the bowler is extending the gloved finger when releasing the ball and applying lift to the ball, thereby forcing the finger toward its flexed or adjusted curved position. This increasing flexing force is directed against the extension of the finger and provides a counter force to the force of the bowling ball against the finger 25 which is directed in the hyper-extended position past the neutral position and which produces stress and strain on the finger. The elastic tension force may be adjusted by varying the elastic quality or quantity of the tension strap so the elastic restoring force, when the middle finger is fully extended my substantially counter balance the force of the bowling ball. The anchor tabs 37 and the straps 39, and complementary strap surface 40, may be varied or changed, as would be known to those skilled in the art, to another suitable fastening device, without departing from the disclosed principles of the invention. In a preferred embodiment, complementary VELCRO hook and loop type, fastening material surfaces, are shown as a suitable means for fastening and holding the anchor tabs 37 in their adjusted position. In connection with anchor straps 39 and the length of the anchor tabs 37, the respective length may be varied or other suitable anchoring means may be used as would be now or hereafter known by those skilled in the art, to extend the displacement range for displacing or moving the anchor tabs 37 or the tensioning strap 25 over and across the anchor means shown as strap 39, in the direction of arrow 47. According to the principles of the disclosed invention, while two anchor tabs 37 are shown, one or a combination of two or more anchor tabs may be used.

FIG. 5 shows the glove of FIGS. 1 and 2 with the fingers 21 in an adjusted curved position and with the tension straps 25 substantially adjacent the finger and palm. The anchor tabs 37 are shown under the straps 39 and in a locked position.

FIG. 6, shows the bowler's fingers in an extended position in the release of the bowling ball with the tension straps shown in phantom mounted within an exterior conduit, as shown in FIG. 3*a*, in a left handed glove and with the exterior conduit extending from proximate the finger tip to an anchor point proximate the bowler's wrist, and with the straps anchoring the tension strap in a closed or anchor position. As shown and disclosed in FIG. 7, with the same numerals as in FIGS. 1 to 6, indicating the same or similar parts, in an exploded view, is a preferred embodiment of the glove 11, with the tension strap 25 mounted between an inner lining 61 and outer lining 63 for the palm and finger as shown in FIGS. 1 and 3, for a left handed glove. As would be understood by those skilled in the art, the disclosed inventive principles are not limited to a right or left handed glove but may be used with each. As would be understood by those skilled in the art, the outer lining 53 is shown displaced opposed to the glove 11 matching inner lining 61.

Figure 7:
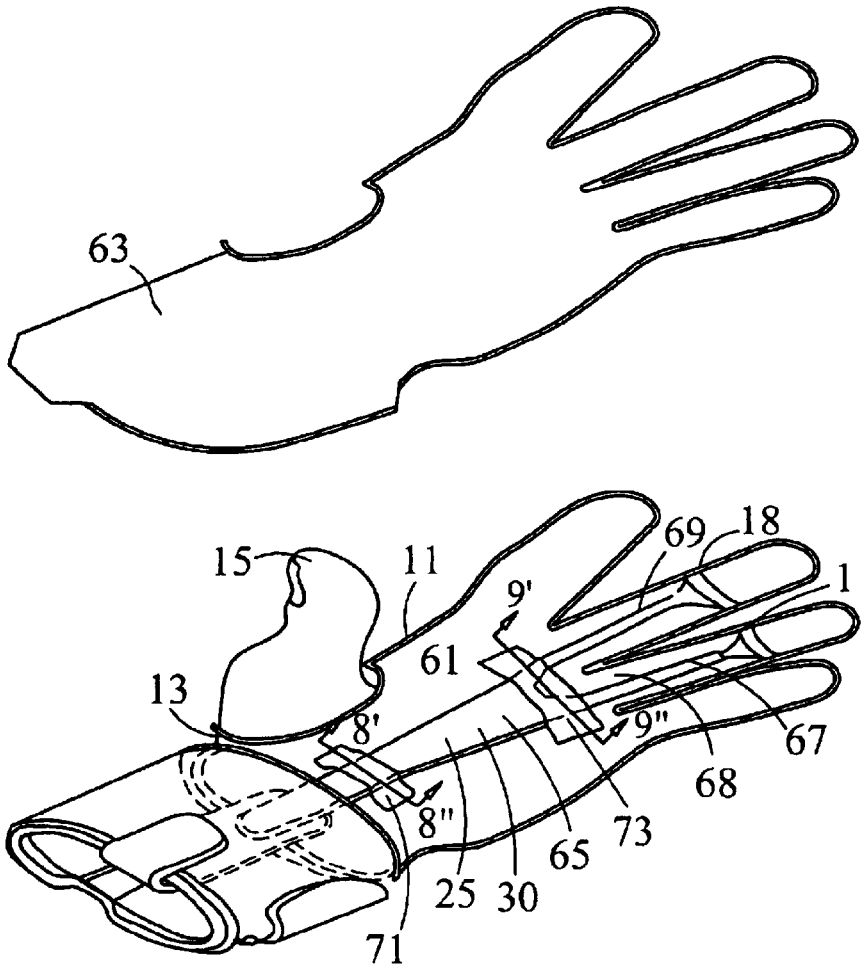
FIG. 7, shows in an exploded view, a preferred embodiment of the glove with the tension strap mounted between an inner and outer lining of the palm of a glove and with the outer lining of glove palm removed, exposing the interior of the glove palm with the exposed tension strap and in a preferred embodiment, two support straps fixed to the glove palm inner lining and positioned opposed to the tension strap to force the tension strap in its adjusted position, to the finger and palm of the bowler's hand.

In a preferred embodiment, as shown in FIG. 7, the strap 25 is shown bifurcated or split into individual respective parts for each of the separate middle fingers. However this invention, as disclosed could be used with a single tension strap or with two or more separated tension straps, as shown in FIGS. 1, 2, 5, and 6. According to a preferred embodiment as shown in FIG. 7, showing the interior 61 of the glove palm with the exposed tension strap 25, shown as a combined single strap section 65 which continues into a split and as shown in a preferred embodiment, split parts 67 and 69 for the separate respective middle fingers. According to a preferred embodiment, as shown in FIG. 7, a means for supporting a force directed against the tension strap 25 to direct the tension strap 25 against the finger and palm and in a locus which is opposed to the finger and palm and which is substantially against the finger. Support straps 71 and 73 are shown placed in a position to oppose the displacement of the tension strap 25 when made subject to a tension force, to develop a counter force or restraining force against the tension strap 25, in the direction of the finger or palm 30 and into a locus extending from the finger tips 18 to the wrist 29, which is substantially adjacent the finger or palm.

While two support straps 73 and 71 are shown, as would be known to those skilled in the art, this invention may be practiced by varying the number or location or position of the support straps 71 or 73, to meet the individual needs of a bowler.

Figure 8:
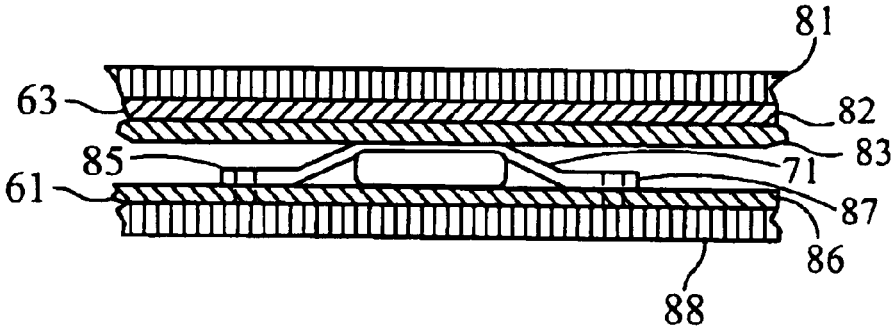
FIG. 8, shows in a cross section, the support strap shown in FIG. 7, positioned across the single tension strap.

In FIG. 8, the cross section of support strap 71 is shown, as taken along section line 8'–8". Fasteners 85, 87 are used to hold the support strap 71 in place on the inner lining 61. As would be known by those skilled in the art, any suitable fastener, for example, rivets, stitching or an adhesive bond may be used. The outer layer 63 is shown comprised of three layers, an exterior layer 81, a middle layer 82, and an interior layer 83. The layers may be made of synthetic or natural material and middle layer 82 may be a sponge like material as would be known to those skilled in the art.

In a preferred embodiment according to the disclosed inventive principles, the inner layer of the glove shown by numeral 63 in FIGS. 7 and 8, comprises two layers, an interior layer 86 and exterior layer 88 which in a preferred embodiment, would be adjacent the finger and palm 30. The number of layers in the inner linings 61, 63 or the materials chosen or the position of the support strap 73, which may be attached to inner layer 61 or outer layer 63, and may be varied in the position placed thereon, without departing from the disclosed inventive principles.

Figure 9:
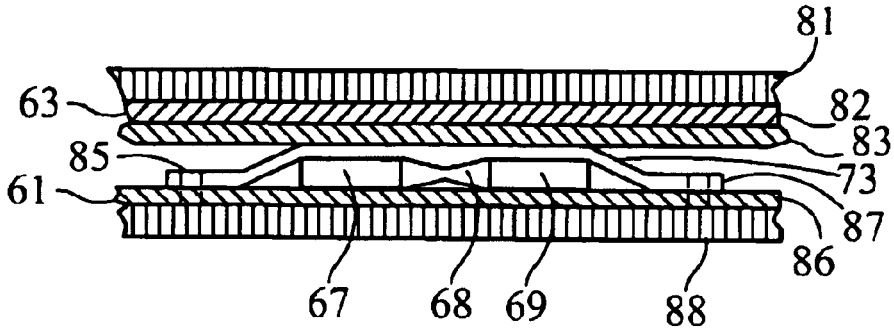
FIG. 9, shows in a cross section the support strap shown in FIG. 7, positioned across the double or bifurcated tension strap.

A preferred embodiment is shown in FIG. 9 of the tension strap 25 as shown in FIG. 7, bifurcated or split for use in two parts 67 and 69 on the two middle fingers. The support strap 73 shown in cross section taken on section line 9'–9", as shown in FIG. 7, is fixed to the inner layer 61 of the glove by fasteners 85, 87. The position of the support strap 73, transverse to, or at an angle to tension strap 25, as explained for support strap 71, causes the support strap to oppose the movement of the tension strap 25 away from the finger or palm, in response to tension applied to the tension strap 25, and forces the tension strap toward and substantially adjacent the finger or palm or the bowler.

Other support straps may be used as individually or form a composite of multiple support straps as shown in a preferred embodiment or may be made integral with the glove linings. The position, location, or material of the support straps or the type of fastening devices used or number of fasteners, used to hold the support straps in place, may be varied without departing from the disclosed inventive principles. Other variation may be made in this disclosed invention shown according to a preferred embodiment, as would be known to those skilled in the art.

What is claimed is:

1. A bowler's glove covering the bowler's middle finger and hand, and proximate the bowler's wrist and including an adjustable tensioning strap to adjust the middle finger into a curved position and with support straps placed across the tension strap to support the tension strap into the adjusted curved position comprising, a. first means for applying a tension force to a bowler's finger for forcing said finger into an adjusted curved position; b. second means for applying a force against said first means for retaining said first means substantially against said finger, when said finger is in said adjusted curved position and wherein said second means includes third means for supporting said force against said first means and wherein said force against said first means is applied in a locus extending from the bowler's fingers to the bowler's wrist and substantially adjacent the bowler's fingers and palm.

2. The bowler's glove of claim 1, wherein said third means includes fourth means for fastening said third means to said second means.

3. The bowler's glove of claim 2, wherein said fourth means includes means for riveting said third means to said second means.

4. The bowler's glove of claim 2, wherein said fourth means includes means for bonding said second means to said third means.

5. The bowler's glove of claim 2, wherein said fourth means includes means for stitching said second means to said third means.

6. The bowler's glove of claim 1, wherein said third means includes means to apply said force at a plurality of locations proximate said first means.

7. The bowler's glove of claim 1, wherein said third means includes means to apply said force transverse to said first means.

8. A system in a bowler's glove covering the bowler's middle finger and hand, and proximate the bowler's wrist and including an adjustable tensioning strap to adjust the middle finger into a curved position, and support straps placed across the tension strap to support a force against tension strap in the adjusted curved position comprising, a. a tension strap mounted in a bowler's glove, between a bowler's finger and wrist;

b. at least one support strap attached to said bowler's glove and mounted in opposition to said tension strap; and wherein said at least one support strap is mounted transverse to said tension strap to develop a force opposed to said tension strap and directed against said tension strap for retaining said tension strap substantially against said finger, when said finger is in said adjusted curved position and wherein said force against said tension strap is in a locus extending from the bowler's fingers to the bowler's wrist and substantially adjacent the bowler's fingers and palm.

9. The system of claim 8, wherein said at least one support strap is mounted at an angle to said bowler's glove.

10. The system of claim 8, including at least one fastener to connect said at least support strap to said glove.

11. The system of claim 10, wherein said at least one fastener is at least one rivet.

12. The system of claim 10, wherein said at least one fastener is stitching.

13. The system of claim 10, wherein said at least one fastener is an adhesive bond.

14. The system of claim 10, including a plurality of said at least one support strap, mounted in a plurality separate respective location.

15. The system of claim 14, wherein said plurality of separate respective locations include as least one location opposed to the glove palm.

16. The system of claim 14, wherein said plurality of separate respective locations include as least one location opposed to the glove middle finger.

17. A method for forcing an adjustable tensioning strap mounted in a bowler's glove between the wrist and middle finger, toward the middle finger and into a locus substantially adjacent the middle finger and palm, when tension is applied to said tension strap to adjust said middle finger into an adjusted curved position, comprising the steps of, a. applying a force to a tension strap to adjust a middle finger into an adjusted curved position;

b. applying a force transverse to and against said tension strap and said bowler's middle finger and palm and displacing said tension strap in a locus opposed to said middle finger and substantially adjacent said middle finger and said palm.

* * * * *